United States Patent [19]

Lee

[11] 4,017,928

[45] Apr. 19, 1977

[54] BLANK TURN-OVER DEVICE FOR HIGH SPEED NUT FORMERS

[76] Inventor: Yuan Ho Lee, 85 Jen Ho Road, Tainan, China /Taiwan

[22] Filed: Dec. 29, 1975

[21] Appl. No.: 645,078

[52] U.S. Cl. ..... 10/76 T; 10/162 A

[51] Int. Cl.[2] ..... B21K 1/64; B21K 27/00; B21J 5/12

[58] Field of Search ..... 10/11 T, 12 T, 72 T, 10/76 T, 162 A, 166; 221/217, 220

[56] References Cited

UNITED STATES PATENTS

| | | | |
|---|---|---|---|
| 252,440 | 1/1882 | Duckworth | 10/12 T |
| 729,822 | 6/1903 | Wetmore | 10/72 T |
| 2,086,684 | 7/1937 | Taylor | 10/12 T |
| 2,544,218 | 3/1951 | Burdsall | 10/12 T |
| 3,069,917 | 12/1962 | Hilgers | 10/12 T |
| 3,259,929 | 7/1966 | Van De Meerendonk | 10/76 T |
| 3,488,784 | 1/1970 | Hatebur | 10/76 T |
| 3,717,890 | 2/1973 | Weller | 10/12 T |

*Primary Examiner*—E. M. Combs
*Attorney, Agent, or Firm*—Lane, Aiken, Dunner & Ziems

[57] ABSTRACT

A blank turn-over device for high speed nut forming machines is disclosed having a vertical shaft provided between two dies. At the bottom end of the shaft a slot or indentation is provided suitable for holding a cut-off nut blank so that when the vertical shaft turns 180°, the cut-off nut blank will be reversed for punching at the next station without making an arched turn-over path.

3 Claims, 6 Drawing Figures

BLANK TURN-OVER DEVICE FOR HIGH SPEED NUT FORMERS

BACKGROUND OF THE INVENTION

In conventional blank turn-over devices, a vertical shaft is provided having a clamping arm at a right angle to the axis of the shaft. The shaft is employed both to turn the blank over and to transfer the blank to the next successive die. To accomplish reversing and transferring of the blank, the vertical shaft drives the horizontal clamping arm for a K80° turn, thereby following an arched path in covering the distance between two dies. Such devices are not adaptable to relatively high speed operation because their construction is relatively complicated, the masses of the mechanisms are relatively large, and the traveling distances between dies is relatively long, thereby requiring relatively large changes of momentum during transfer over long paths between the two dies should high speed operation be attempted. For these and other reasons, conventional turn-over devices have operating speed limitations which are relatively restrictive.

The object of the present invention is to minimize or avoid the problems associated with conventional devices by providing a turn-over device which does not make a 180° turn along an arched path of travel to accomplish turn-over or reversal of nut blanks and which is not required to transfer the nut blanks. The improved turn-over device of the present invention minimizes inertia effects and mechanical complexity, thereby making possible extra high speed operation. A nut blank feeding device suitable for use with the turn-over device of the present invention to achieve transfer of the nut blanks is described in a concurrently filed and copending application (Ser. No. 645,078, filed Dec. 29, 1975) by the same inventor, and, accordingly, relevant description is omitted here.

SUMMARY OF THE INVENTION

The present invention provides a turn-over device for cut-off nut blanks in high speed nut former machines and uses a vertical shaft provided on the same end of the nut former machine body as the dies used for punching operations on the nut blanks. The shaft is located between two dies and has a clamping means in the shape of an inverted U provided at its lower end. In operation, a cut-off nut blank is first fed into the clamping means. Following this, the vertical shaft is driven by a manipulating mechanism to turn the clamping means by 180°. This reverses the cut-off nut blank so that it is in its original linear position except that it is reversed.

BRIEF DESCRIPTION OF THE DRAWINGS

Two embodiments of the present invention are now described with reference to the appended drawings, wherein.

DETAILED DESCRIPTION OF THE PREFERRED EMBODIMENTS

Figure 1:
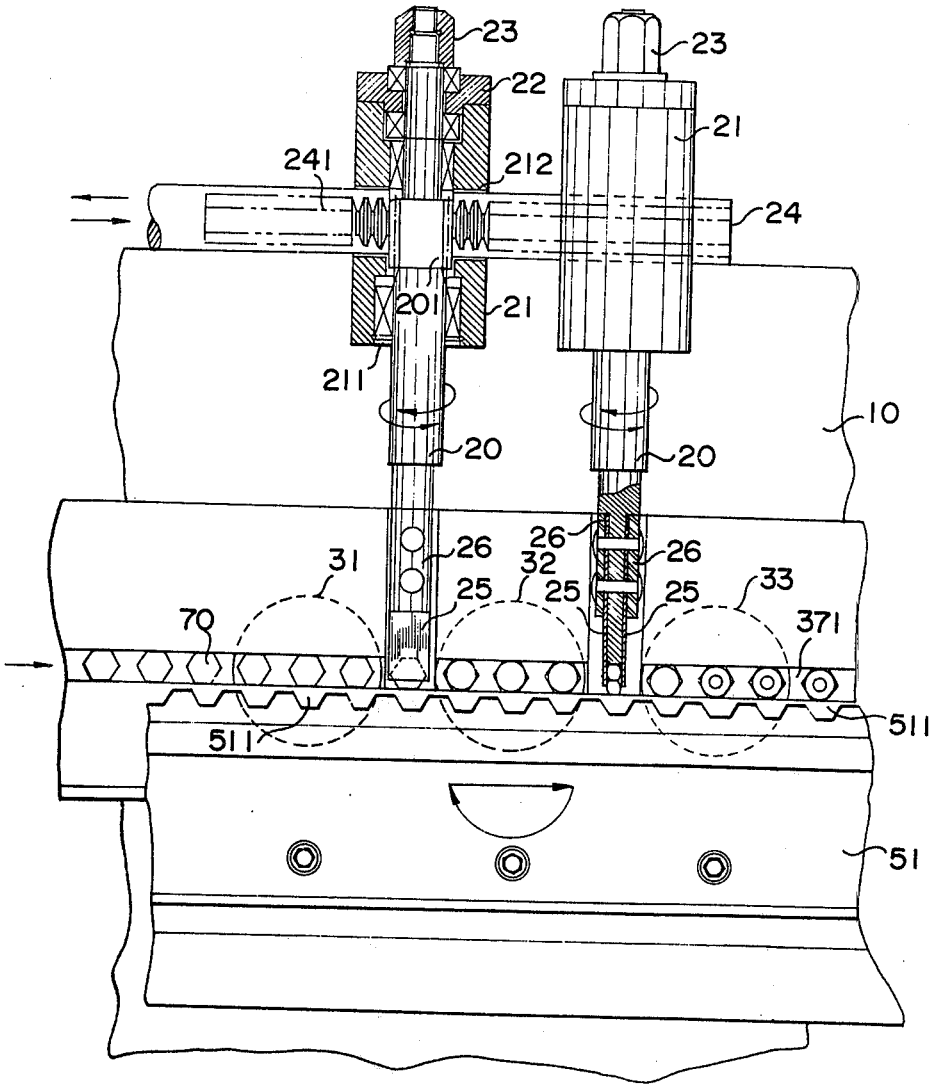
FIG. 1 is a plan view of a first embodiment according to the present invention.
Figure 2:
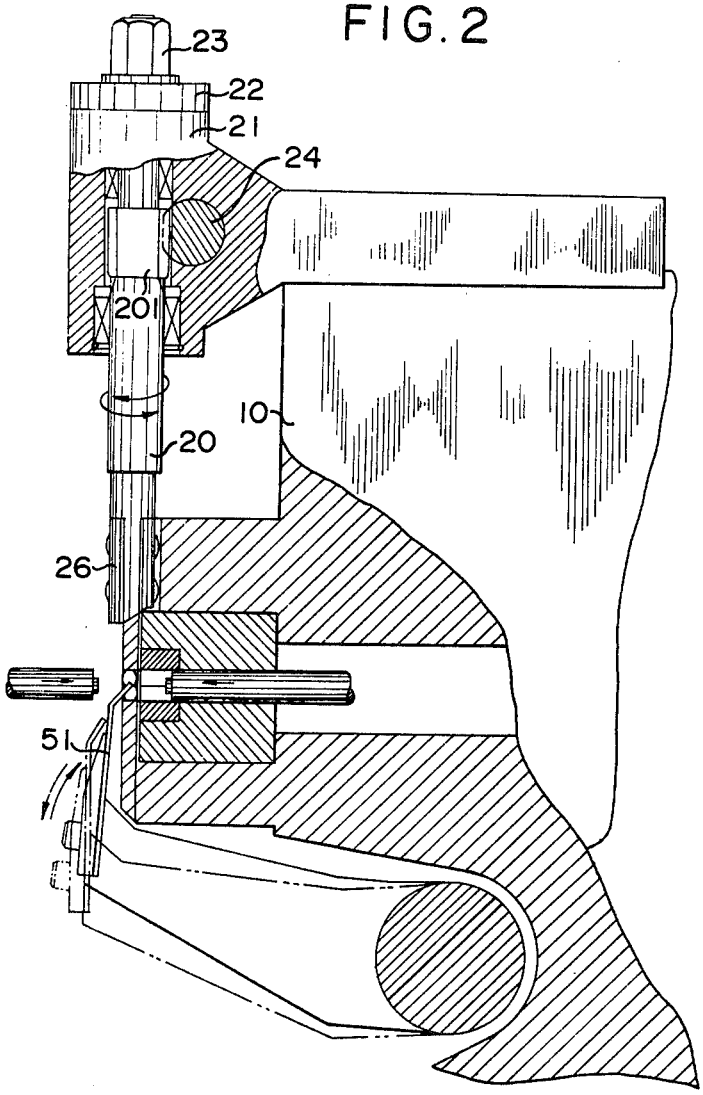
FIG. 2 is a partial cross sectional view of the first embodiment.
Figure 3:
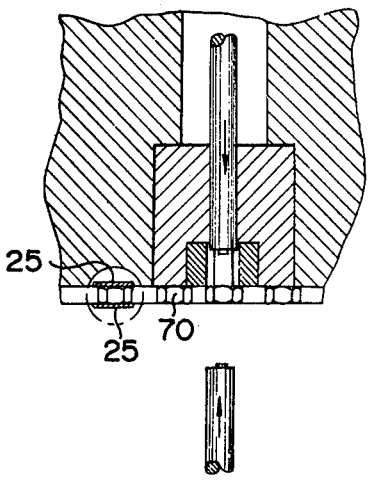
FIG. 3 is a cross sectional view of the first embodiment.

As shown in FIGS. 1, 2 and 3 a plurality of dies 31, 32 and 33 are provided equidistantly from each other on a machine body 10. Sleeves 21—21 are also provided on the machine body 10, each having a cavity 211. Each cavity has its axis perpendicular to a line drawn through and connecting the centers of the dies 31, 32 and 32, 33 respectively. Each cavity 211 is also provided with a number of bearings to accomodate a turn-over shaft 20 which is provided with a gear 201. The upper end of each cavity 211 is further provided with a cover 22 and a nut 23 to engage with the threaded end of the shaft 20 to secure the shaft rotably in the sleeve 21. In addition, the sleeve 21 is provided with a horizontal cavity 212 at a suitable place as shown to accomodate a horizontal rod 24 which is connected at one end to a manipulating mechanism (not shown) to move in a left-right reciprocating motion. The rod 24 is provided with teeth 241 to engage with the teeth of a gear 201 of the shaft 20 so as to drive the shaft in a reciprocating rotary motion. The lower end of the shaft 20 is divided into a fixed plate 26 and spring plates 25—25 secured to the fixed plate by means of rivets or bolts to constitute a clamping means with an opening in the shape of an inverted U having suitable height and width to function properly in a feeding path 371. When the spring plates 25—25 are in a plane parallel with the plane of the feeding path 371, the clamp means are adapted to receive into the opening thereof a workpiece 70 which is pushed between the spring plates 25—25 by the advancing motion of a feeding plate 51 which is provided along its periphery with indentations 511—511. The indentations 511 are formed to correspond to one half of the external shape of workpiece 70 or a finished product. After the workpiece 70 has been thus pushed between the spring plates 25—25, the shaft 20 will be driven by the toothed reciprocating rod 24 to turn 180° in either a left to right or right to left rotary motion, thereby turning over the workpiece 70 which is clamped securely between the spring plates 25—25. After the workpiece has been turned 180° from its original position, the rotary shaft will cease to turn and the workpiece 70 will be advanced out of the clamp by means of the feeding plate 51 and the indentations 511 provided thereon. Simultaneously, the next workpiece will be delivered between the spring plates 25—25 to be turned over in another operation the same as just described.

Figure 4:
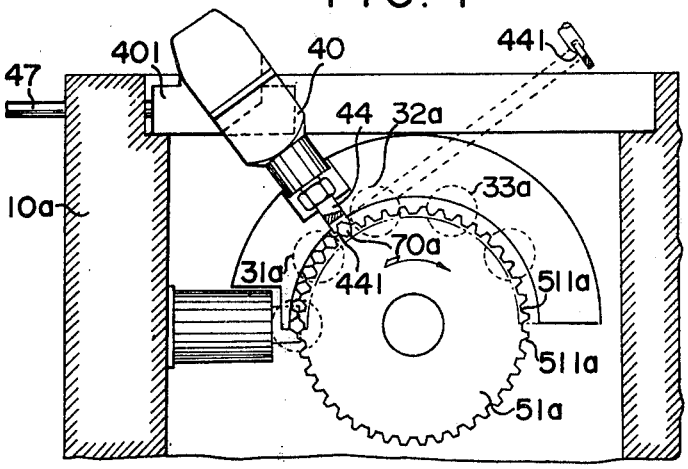
FIG. 4 is a partial cross sectional view of a second embodiment according to the present invention.
Figure 5:
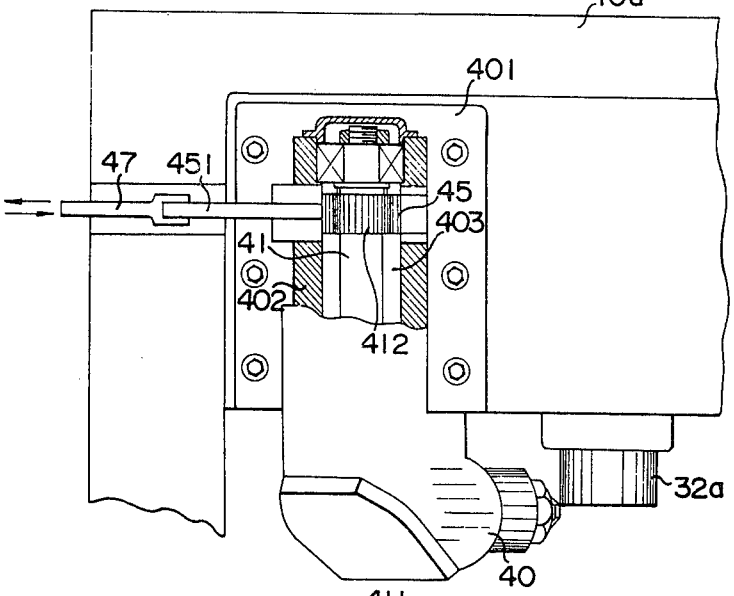
FIG. 5 is a top view in partial cross section of the second embodiment.
Figure 6:
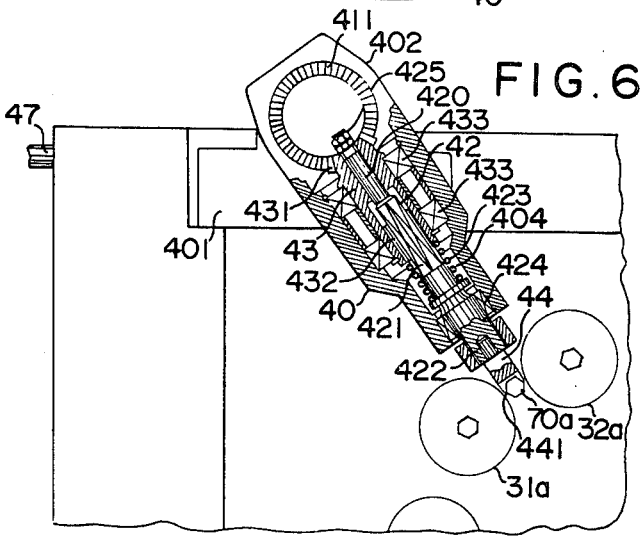
FIG. 6 is a cross section of the shaft according to the second embodiment of the present invention.

As shown in FIGS. 4, 5 and 6, a second embodiment of the turn-over device according to the present invention involves a turn-over device suitable for use with a rotary feeding disc 51*a* which has provided along its periphery indentations 511*a*—511*a* which correspond in shape of one half of the external shape of a workpiece or formed product. A plurality of dies 31*a*, 32*a*, 33*a*, are insertably provided on a machine body 10*a* having their centers arranged equidistantly from each other at spaced intervals on the circumference of a feeding disc 51*a*. A base 401 is secured to the machine body 10*a*. The upperside of the base 401 is provided with a base body 402 which extends beyond the face of the machine body 10*a*. The base body 402 is provided with a main body 40 which extends downwardly at a suitable angle as shown so that the axis thereof is perpendicular to a line drawn between the centers of two adjacent dies. The based body 402 is further provided with a cavity 403 to accommodate a rotary shaft 41 and the main body 40 is provided with a cavity 404 aligned so that the axes of cavities 403 and 404 intersect.

A rotary shaft 42 is provided within the cavity 404, and is divided into an upper portion 420 a square portion 421 and a bottom portion 422. The cavity 404 is also provided at the sides of its middle section with a plurality of bearings 433—433 which pivotedly support a hollow outer shaft 43 which is coaxial with the rotary shaft 42. The hollow outer shaft 43 has a bevel pinion 431 fixed integrally at its upper end. The inner circular surface of the hollow shaft 43 is provided with a square shaft hub 432. The square portion 421 of the shaft 42 is inlaid into the shaft hub 432. The uppermost end of the shaft 42 is round and is slidingly inserted in and secured to the bevel pinion 431 by means of nuts 425. The central portion of the shaft 42, which is a square portion 421, rests in a square shaft hub 432 and is provided at the lower end with a spring 423 to allow freedom of movement of the shaft 42 along its axis. The lower end of the shaft 42, the bottom portion 422, is pivotally connected to the main body 40 by means of bearings 424. A clamping arm 44 is provided on the bottom portion 422 of the shaft 42 and extends beyond the main body 40 on the same axis as the main body 40. The clamping arm is provided with a gripping portion 441 which has an inverted U shape. The gripping portion 441 is situated at a point corresponding to one half the thickness of the feeding disc 51*a*.

A driving mechanism (not shown) is provided to drive rotary shaft 41. The driving mechanism (not shown) is provided with a drive rod 47 which is connected to a linking rod 451 which is in turn linked to a toothed strip 45. In cross section, the toothed strip 45 is shaped like an I and is provided with teeth on the upper portion thereof which mesh with a pinion 412. The pinion 412 is secured on the shaft 41. A drive shaft (not shown) driven by the driving mechanism (also not shown) drives the drive rod 47 in a reciprocating manner, thus causing connected linking rod 451 and the toothed strip 45 meshed with the pinion 412 to drive the shaft 41 in a reciprocating rotary motion. The shaft 41 is provided with a bevel gear 411 meshed with a bevel pinion 431. This gearing arrangement causes the rotary shaft 42 and the clamping arm 44 to rotate 180° in reciprocating rotary motion.

The turn-over operation according to this second embodiment of the invention is almost identical to that described above for the first embodiment. A workpiece 70*a* is introduced into the opening of gripping portion 441 of clamping arm 44 by the intermittent rotary motion of the feeding disc. After the workpiece has entered the opening, the drive assembly just described will cause the clamping arm 44 to rotate 180° on its axis, thereby turning over workpiece 70*a*. After the workpiece is turned over, it is pushed out of the gripping portion 441 due to following the advancement of the feeding disc 51*a*. Then, the next workpiece is introduced into the gripping portion 441, and the turn-over operation repeats.

Accordingly, can be seen that the present invention provides a simple turn-over device for nut forming machines which avoids the adverse inertia effects found in prior art turn-over devices and which because of its simple construction, is relatively unlikely to malfunction. Because of these advantages, the turn-over device of the present invention is adaptable to extra high speed operation. While the present invention has been explained and described with reference to two particular embodiments, it will be understood that numerous modifications and variations may be incorporated without departing from the spirit or scope of the invention.

I claim:

1. A blank turn-over device for use in a high speed nut former machine which includes a machine body having at least a pair of spaced dies and means defining a feeding path for workpieces between the centers of at least a successive pair of said spaced dies comprising:

a shaft which is rotatable about its axis and positioned relatively perpendicularly to said feeding path; and gripping means, located at the end of said shaft and coaxial with said shaft, for gripping workpieces in said feeding path, said gripping means cooperating with said shaft to perform the successive functions of receiving a workpiece in said feeding path and turning over said workpiece in said feeding path without lateral displacement of said workpiece from said path upon a rotation of the shaft about its axis on the order of 180° for subsequent removal of said workpiece from said gripping means in said feeding path.

2. A turn-over device according to claim 1 comprising:

means for driving the shaft in 180° reciprocating rotary motion; and means for conveying workpieces in said feeding path to and from the gripping means in sequence so that a workpiece may be fed to and releasably gripped in the gripping means and, after turn-over has been effected, fed from the gripping means; and wherein the gripping means comprises a clamping device having an inverted U-shaped opening.

3. A turn-over device according to claim 1 comprising:

a rotary feeding disc provided on said machine body to feed workpieces in intermittent rotary motion along said feeding path to and from said gripping means and between the centers of said dies, the centers of said dies being arranged along the periphery of the rotary feeding disc; and means for driving the shaft comprising a rotary shaft and means for pivotally connecting the rotary shaft to the shaft so that when the rotary shaft is driven in reciprocating rotary motion, the shaft moves in reciprocating rotary motion.

* * * * *